US007198188B2

(12) United States Patent
Dion et al.

(10) Patent No.: US 7,198,188 B2
(45) Date of Patent: Apr. 3, 2007

(54) HARDWOOD FLOORING NAILER HAVING AN ADJUSTABLE DOUBLE HANDLE

(75) Inventors: Marc Dion, St-Augustin-de-Desmaures (CA); Jacques Maltais, Beauport (CA)

(73) Assignee: Laboratoire Primatech Inc., Quebec (CA)

( * ) Notice: Subject to any disclaimer, the term of this patent is extended or adjusted under 35 U.S.C. 154(b) by 39 days.

(21) Appl. No.: 11/011,648

(22) Filed: Dec. 14, 2004

(65) Prior Publication Data

US 2006/0124683 A1 Jun. 15, 2006

(51) Int. Cl.
*B25B 23/06* (2006.01)
*B27C 3/08* (2006.01)

(52) U.S. Cl. ..... 227/110; 227/8; 227/111; 227/129; 16/426

(58) Field of Classification Search ..... 227/8, 227/110, 111, 112, 147, 148, 119, 129; 16/426
See application file for complete search history.

(56) References Cited

U.S. PATENT DOCUMENTS

| | | | | | |
|---|---|---|---|---|---|
| 3,281,046 | A | | 10/1966 | Boulay | |
| 3,542,273 | A | * | 11/1970 | Hedrick | 227/130 |
| 3,711,008 | A | | 1/1973 | Clifford et al. | |
| 4,197,764 | A | * | 4/1980 | Auernhammer | 74/544 |
| 4,235,269 | A | * | 11/1980 | Kraus | 81/438 |
| 4,907,730 | A | * | 3/1990 | Dion | 227/8 |
| D323,272 | S | | 1/1992 | Dion | |
| 5,193,729 | A | * | 3/1993 | Dewey et al. | 227/8 |
| 5,269,045 | A | * | 12/1993 | DeSerio et al. | 16/422 |
| 5,329,834 | A | * | 7/1994 | Wong | 81/58.3 |
| 5,555,780 | A | * | 9/1996 | Beach et al. | 81/57.37 |
| 5,644,844 | A | * | 7/1997 | Pink | 30/276 |
| 5,943,925 | A | * | 8/1999 | Huang | 81/177.2 |
| D419,048 | S | | 1/2000 | Batts, Jr. et al. | |
| 6,095,392 | A | | 8/2000 | Batts, Jr. et al. | |
| 6,155,472 | A | | 12/2000 | Déziel | |
| D438,769 | S | | 3/2001 | Déziel | |
| 6,230,367 | B1 | * | 5/2001 | Riedl | 16/436 |
| 6,296,064 | B1 | * | 10/2001 | Janusz et al. | 173/30 |
| 6,609,860 | B2 | * | 8/2003 | Wanek et al. | 408/14 |
| 6,814,156 | B2 | * | 11/2004 | Dieterle et al. | 173/170 |
| 6,834,789 | B1 | * | 12/2004 | Dion et al. | 227/148 |
| 6,863,479 | B2 | * | 3/2005 | Frauhammer et al. | 408/241 R |
| 2001/0035073 | A1 | * | 11/2001 | Janusz et al. | 81/57.37 |
| 2002/0125022 | A1 | * | 9/2002 | Dieterle et al. | 173/170 |
| 2005/0034276 | A1 | * | 2/2005 | Badiali | 016/426 |
| 2005/0091783 | A1 | * | 5/2005 | Sepke et al. | 15/320 |

* cited by examiner

*Primary Examiner*—Brian Nash
(74) *Attorney, Agent, or Firm*—Francois Martineau

(57) ABSTRACT

A hardwood flooring nailer destined to be loaded with at least one fastener, the nailer comprising a main rigid frame, and a fastener discharge mechanism attached to the main frame and which can be activated for allowing the nailer to discharge a fastener. The nailer also includes an adjustable double handle transversely carried by the main frame and comprising a first handle and a second handle, and mounting means mounting the first handle to the second handle. The first and the second handle can be selectively moved relative to one another in order to adjust the double handle in one of several different grasping configurations.

6 Claims, 9 Drawing Sheets

HARDWOOD FLOORING NAILER HAVING AN ADJUSTABLE DOUBLE HANDLE

FIELD OF THE INVENTION

The present invention relates to fastener discharge mechanisms, and more particularly to a nailer for hardwood flooring having an adjustable double handle.

BACKGROUND OF THE INVENTION

Hardwood flooring generally consists of a number of juxtaposed elongated tongue-and-groove planks interlocked with each other, and then fastened in position to a subjacent subfloor. To fasten these hardwood planks to the subfloor of a room (composed for example of plywood plates and/or floor joists), it is known to use mallet-operated fastener driving tools. These fastener driving tools, or nailers, generally comprise a main body with a floor-engageable shoe mounted to its bottom surface, upon which the tool rests against a hardwood plank prior to discharging a fastener in the latter. These fastener driving tools also comprise a magazine containing fasteners in the form of metallic L- or T-shaped barbed cleats, or staples, and feeding them to a fastener discharge mechanism, which can be activated when a trigger thereof is struck with a mallet. Such nailers are generally made of heavy-duty materials such as cast aluminium, and are therefore overall substantially weighty.

In general, a workman must position and secure the hardwood planks to the subfloor one at a time, to gradually form the hardwood flooring. After having positioned a plank on the floor in order for it to be interlocked with the other surrounding tongue-and-groove planks, the workman lays his nailer atop this plank and then strikes the nailer's trigger with a mallet. This causes the nailer to discharge a fastener through the hardwood plank to secure the latter to the subfloor.

The above steps are then repeated until the hardwood flooring is entirely installed. The workman positions a plank, nails it down to the subfloor, and then repeats this procedure to set up the whole flooring, meanwhile dragging the heavy nailer in one hand, and the mallet in his other hand.

As useful as they may be, these heavy nailers are generally not very ergonomic. Indeed, in addition to having to move it around from a nailing point to another, the workman generally has to bend downwardly in an awkward stance to lay it atop a hardwood plank and to strike heavily on the nailer's trigger with his mallet to activate it. Sustained usage thereof hence generally causes the workman to quickly become tired and feel discomfort, especially in the arms and back.

Also, another consequence of the substantial weight of these nailers is that they are hard to precisely manipulate.

SUMMARY OF THE INVENTION

The present invention relates to a nailer for hardwood flooring, said nailer destined to be loaded with at least one fastener, said nailer comprising:

- a main rigid frame, for use with a fastener discharge mechanism attached to said main frame and which can be activated for allowing said nailer to discharge a fastener;
- an adjustable double handle transversely carried by said main frame and comprising a first handle and a second handle, and mounting means mounting said first handle to said second handle;

wherein said first and said second handle can be selectively moved relative to one another in order to adjust said double handle in one of several different grasping configurations.

In one embodiment, said first handle is attached to said nailer main frame, said second handle is movably attached to said first handle transversely thereto, and said second handle can be selectively moved relative to said first handle in order to adjust said double handle in one of said several grasping configurations.

In one embodiment, said mounting means include releasable locking means, said locking means allowing said movable second handle to be selectively locked in position, thus allowing said double handle to be selectively locked in one of said several grasping configurations.

In one embodiment, said first handle is fixedly connected to said nailer main frame transversely thereto.

In one embodiment, said second handle is pivotally attached to said first handle, said second handle being pivotable about a first pivot axis.

In one embodiment, said first handle is elongated and extends along a first handle axis, and said second handle is L-shaped and defines a spacer portion pivotally attached by a first end thereof to said first handle, and carrying at a second end a handgrip portion of said second handle, said handgrip portion being elongated and extending along a second handle axis.

In one embodiment, said first pivot axis and said first handle axis are coextensive to each other, said second handle being thus selectively pivotable relative to said first handle axis.

In one embodiment, said first handle axis and said second handle axis remain substantially parallel to each other in all of said grasping configurations of said double handle.

In one embodiment, said second handle is pivotally mounted to said first handle axis, said second handle being pivotable about a first pivot axis, and said handgrip portion of said second handle is pivotally connected to said spacer portion, and is pivotable relative thereto about a second pivot axis transversal to said first pivot axis.

In one embodiment, said first handle is pivotally attached to said nailer main frame, said first handle being pivotable about a third pivot axis transversal to said first and said second pivot axes.

The present invention also relates to a handle assembly for use on a hardwood flooring nailer, comprising:

- a handle including a spacer portion and a handgrip portion, said spacer portion and said handgrip portion being interconnected transversely to one another; and
- mounting means attachable to said auxiliary handle spacer portion, and movably mounting said auxiliary handle to the hardwood flooring nailer for relative movement thereabout.

In one embodiment, said spacer portion and said handgrip portion of said handle are fixedly interconnected.

In one embodiment, said spacer portion and said handgrip portion of said handle are pivotally interconnected.

In one embodiment, said mounting means are pivotable mounting means for allowing said handle to be selectively pivotable relative to the hardwood flooring nailer.

DETAILED DESCRIPTION OF THE EMBODIMENTS

Figure 1:
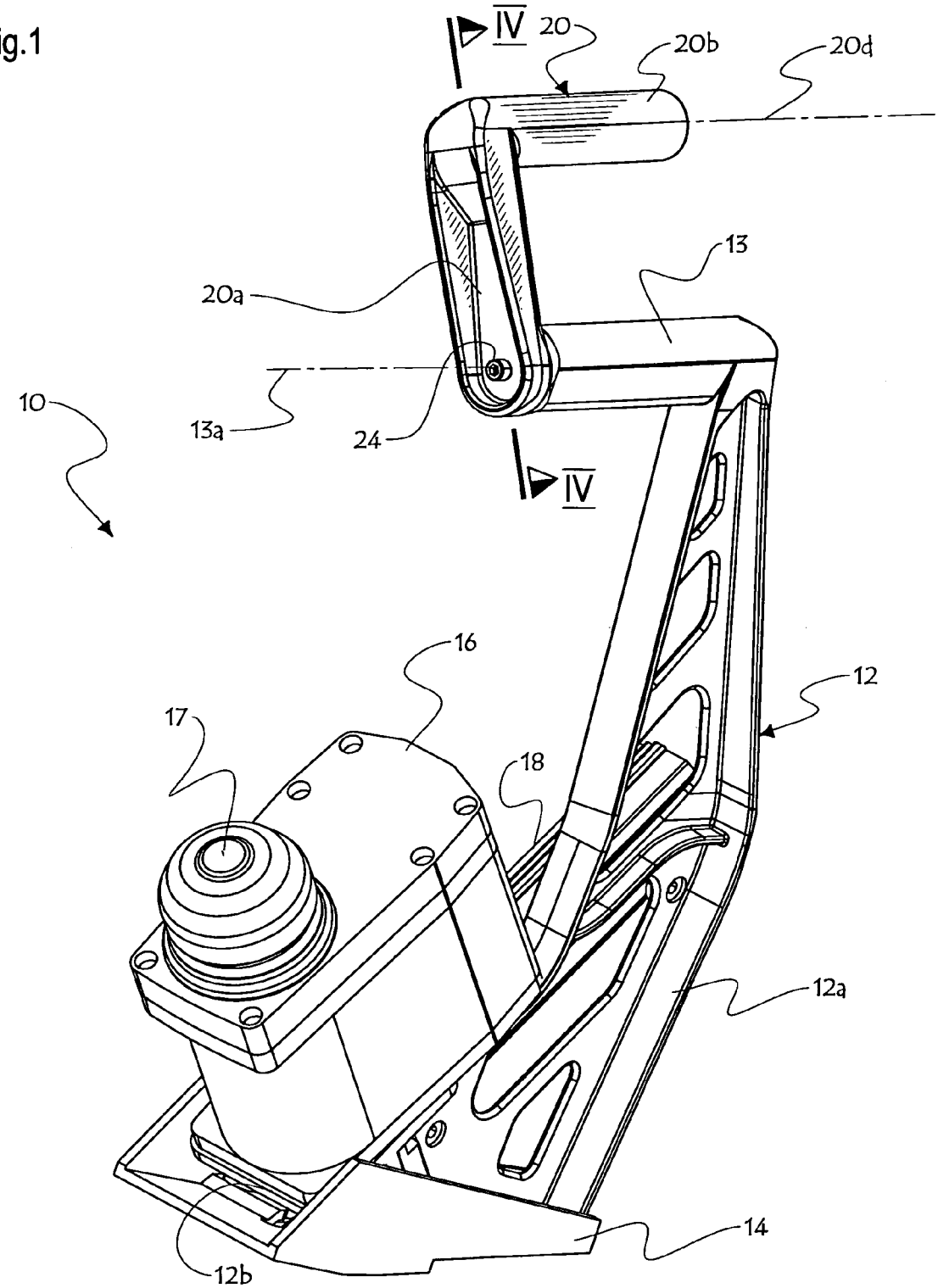
FIG. 1 is a perspective view of a hardwood flooring nailer including an adjustable double handle according to the present invention.
Figure 2:
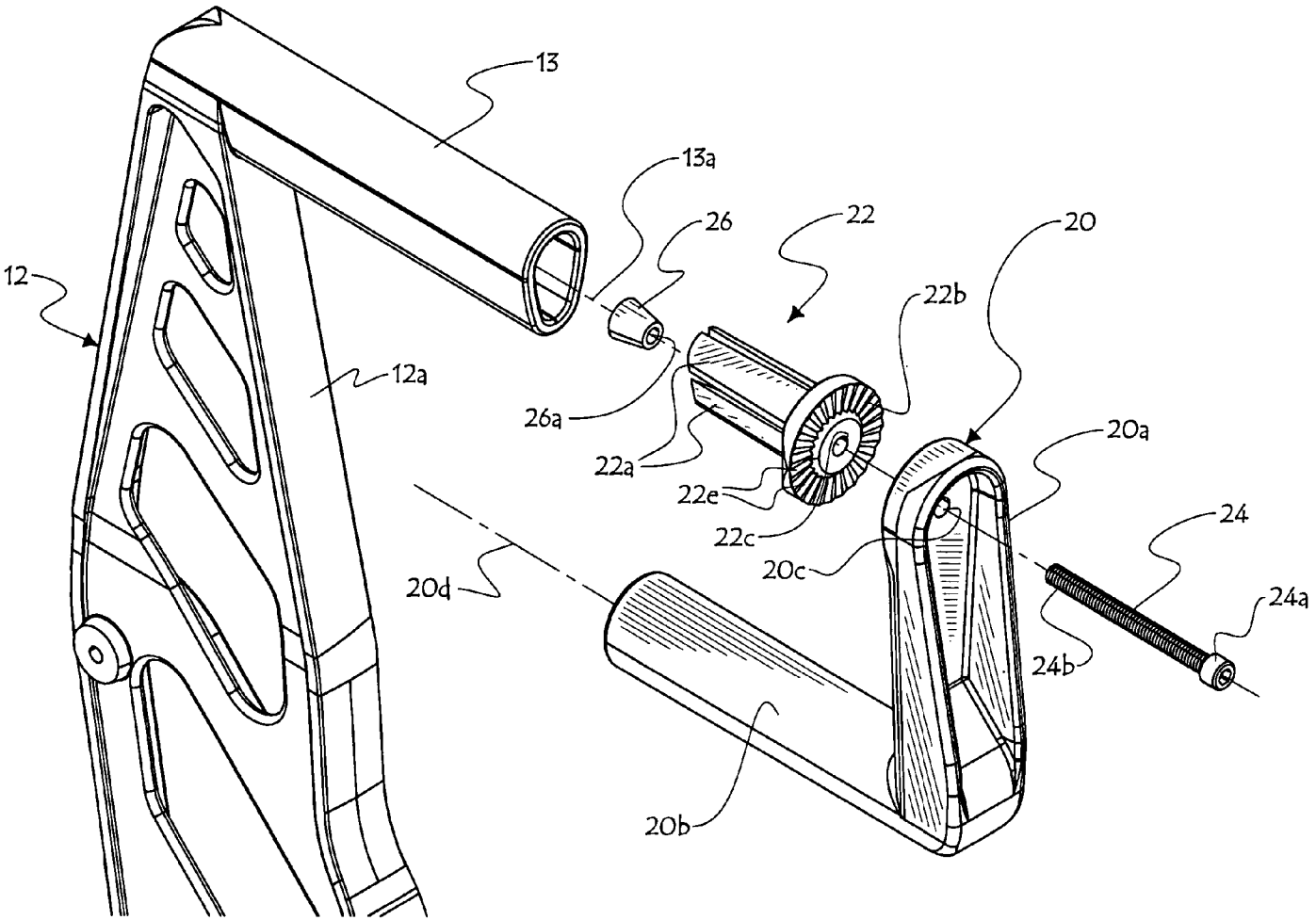
FIG. 2 shows an exploded, enlarged front perspective view of the upper portion of the nailer of FIG. 1 showing in particular the mounting means of the auxiliary handle, which are partly concealed in FIG. 1.

FIGS. 1–7 show one embodiment of the present invention. In particular, these figures show a pneumatic nailer 10 capable of discharging fasteners such as L- or T-shaped cleats for example, and designed for securing hardwood planks to a subfloor. Nailer 10 comprises a generally C-shaped main frame 12, made of a sturdy material such as cast aluminium for example. Main frame 12 defines a central portion 12*a* carrying a bottom portion 12*b* at its lower end, and a tubular elongated main handle 13 at its upper end. A nailer sole 14 is attached at the bottom of main frame 12, and is intended to engage a tongue and groove type plank (or other workpiece) when nailer 12 is laid atop thereof. Nailer 10 further comprises a mechanism housing 16 attached to main frame central portion 12*a*, and in which is nested a fastener discharge mechanism (not shown) connected to a compressed air source (not shown). An anvil trigger member 17 projects outwardly frontwardly of mechanism housing 16, and is operatively connected to its internal fastener discharge mechanism. A magazine 18 is mounted on the side of main frame 12, and can accommodate one or more strips of fasteners such as L- or T-shaped cleats or flooring staples. Magazine 18 has the purpose of feeding these fasteners to the fastener discharge mechanism nested in housing 16. Moreover, an auxiliary handle 20 is transversely mounted in a pivotal fashion to main handle 13.

As known in the art, a workman must forcefully strike the anvil trigger member 17 with a mallet to trigger and activate the fastener discharge mechanism nested in housing 16, to which magazine 18 continuously feeds fasteners, in order for nailer 10 to discharge a fastener. Once activated, the fastener discharge mechanism forcibly ejects a fastener out of nailer 10.

Figure 3:
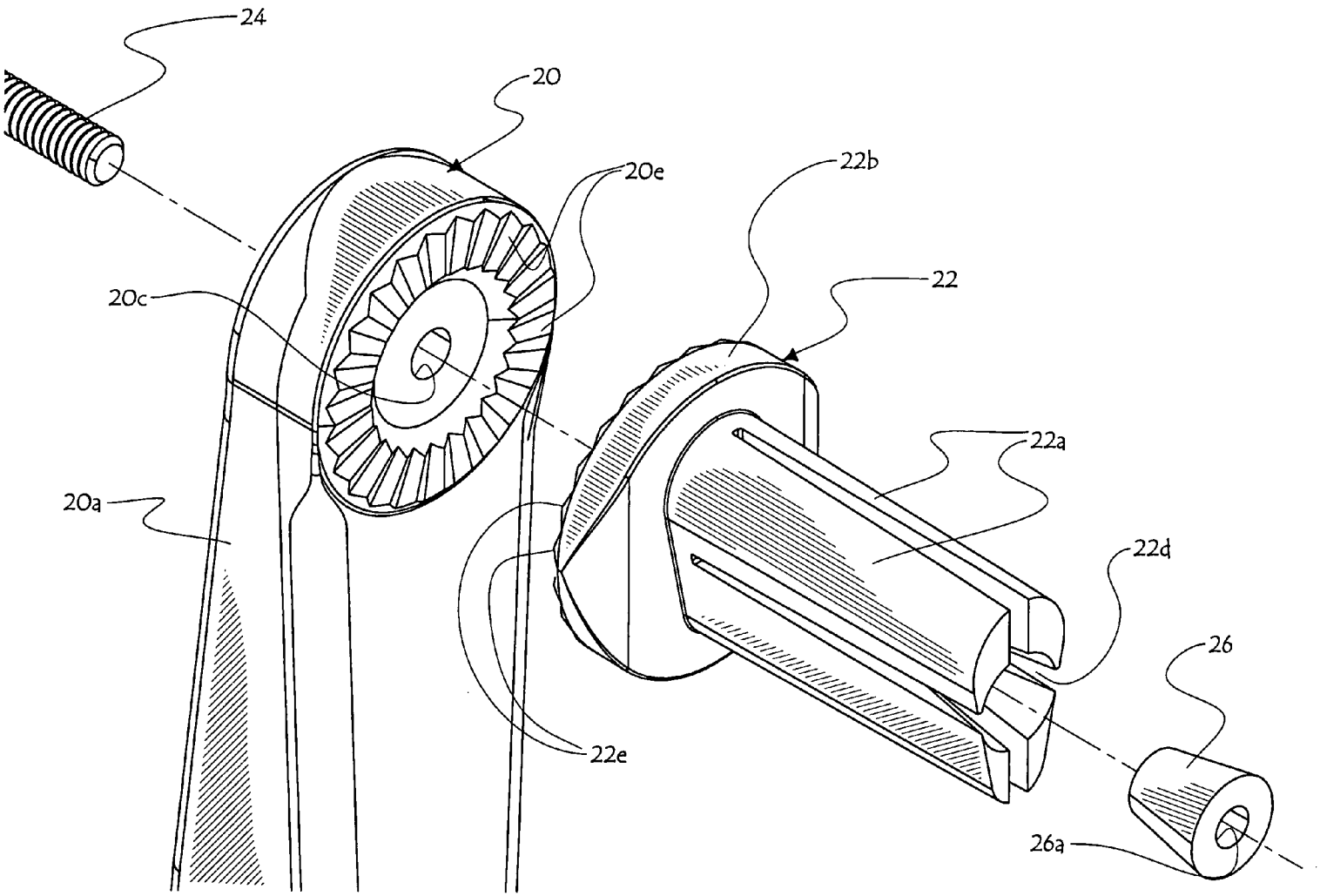
FIG. 3 is an enlarged rear perspective view showing in particular the back of the spacer portion of the auxiliary handle.
Figure 4:
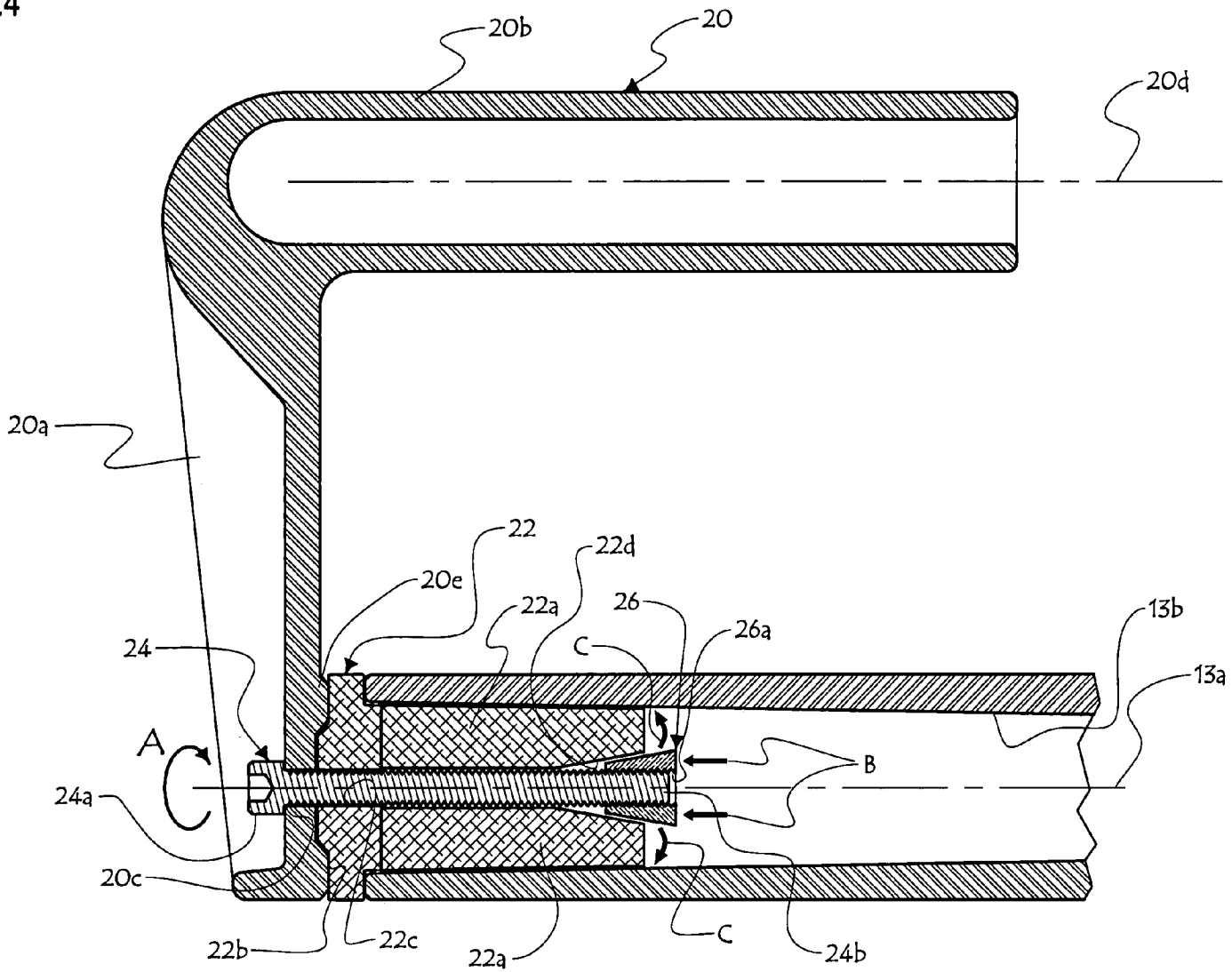
FIG. 4 is a cross-sectional view at an enlarged scale of the double handle of the nailer taken along lines IV—IV of FIG. 1.

The handling means of nailer 10, to which the present invention pertains, will now be detailed. As mentioned above and as best shown in FIGS. 2–4, main frame 12 defines an elongated and tubular main handle 13 extending along a main handle axis 13*a*. According to the present invention, nailer 10 is also provided with an additional auxiliary handle 20 transversely attached to main handle 13, and selectively pivotable about main handle axis 13*a* in a 360° angular spread. Auxiliary handle 20 defines a spacer portion 20*a* transversely projecting from handle 13, and carrying a handgrip portion 20*b* transversely at one end; adjacent to the other end of handle portion 20*a*, a hole 20*c* is made through spacer portion 20*a*. Handgrip portion 20*b* is elongated and extends along an auxiliary handle axis 20*d*, and can be tubular for example. Moreover, spacer portion 20*a*, on the rear surface thereof (as illustrated in FIG. 3), defines a knurled surface composed of an annular array of radially-oriented, regularly-spaced corrugations 20*e* surrounding hole 20*c*. These radial corrugations 20*e* are angularly spaced from each other by 10° or 15° for example.

Auxiliary handle 20 is provided with mounting means allowing its pivotable connection to main handle 12. These mounting means comprise an insert 22 having a number of elongated, peripherally juxtaposed spreadable leaves 22*a* intended to be inserted by their outer distal free ends in cavity 13*b* of tubular main handle 13. These leaves 22*a* are all integrally and fixedly connected at their proximal ends to a discoid head portion 22*b* of insert 22. Elongated leaves 22*b* are shaped and positioned one relative the other such that leaves 22*b*, in combination, fit snugly in the internal peripheral cavity 13*b* of tubular main handle 13. Moreover, an elongated cavity 22*d* is formed between leaves 22, which registers axially with a bore 22*c* made through head portion 22*b* of insert 22. It is noted that the outer surface of head portion 22*b*, i.e. the surface of head portion 22*b* opposite leaves 22*a*, is provided with an annular array of corrugations 22*e* surrounding bore 22*e*, this array being interlockingly compatible with the array of corrugations 20*e* of auxiliary handle 20.

The auxiliary handle mounting means also include an adjustment pin 24, defining a head 24*a* having an outer diameter larger than that of hole 20*c* of auxiliary handle 20, and an elongated threaded shank 24*b*. Threaded shank 24*b* of adjustment pin 24 runs successively through hole 20*b* of auxiliary handle 20, through bore 22*c* of insert head portion 22*b*, and along cavity 22*d*, while pin head 24*a* abuts against the material of spacer portion 20*a* surrounding hole 20*c*. A wedge 26, of frustoconical shape for example, and having a threaded inner cavity 26*a* is screwed on threaded shank 24*b* adjacent its outer free end, such that insert 22 be located between wedge 26 and auxiliary handle spacer portion 20*a*.

Prior to installing auxiliary handle 20 on nailer 10, the mounting means are all assembled onto auxiliary handle 20, i.e. pin 24 is inserted in hole 20*c* of auxiliary handle 20, insert 22 is slipped onto pin shank 24, and wedge 26 is screwed on threaded shank 24 until insert 22 is slightly stuck between wedge 26 and auxiliary handle 20. In this configuration, wedge 26 slightly frictionally engages insert leaves 22*a*. Then, this auxiliary handle 20/mounting means assembly is mounted to main handle 13, i.e. leaves 22*a* of insert 22 are forced in main handle cavity 13*b*. Then, with a screwdriver or other appropriate tool, adjustment pin 24 is pivoted in a given direction, as suggested by arrow A in FIG. 4. The initial frictional engagement of wedge 26 against leaves 22*b*, prevents wedge 26 from pivoting integrally with pin 24, and pin 24 thus pivots relative to wedge 26. This causes wedge 26 to be further screwed about pin 24, and wedge 26 is thus threadingly axially displaced in direction of and further into insert cavity 22*d*, as suggested by arrows B in FIG. 4. Consequently, wedge 26 becomes wedged between leaves 22*a* and spreads them apart (as suggested by arrows C in FIG. 4), so as to bias and press them against the inner peripheral wall of main handle inner cavity 13*b*. Simultaneously, the rotation of pin 24 in this direction progressively brings together auxiliary handle 20 and insert head portion 22*b*. Once adjustment pin 24 is firmly tightened, auxiliary head spacer portion 20*a* is pressed against insert head portion 22*b*, and the two facing arrays of corrugations 20*e* and 22*e* perfectly interlock.

In the embodiment shown in FIGS. 1–7, when locked in position, auxiliary handle 20 is shown to be parallel to main handle 13, but could be convergent in alternate embodiments.

During use of nailer 10, the pivotal position of its auxiliary handle 20 can be adjusted at the user's will. To adjust the pivotal position of auxiliary handle 20 relative to main handle 13, adjustment pin 24 can be pivoted and loosened, to allow corrugations 20*e* of auxiliary handle 20 to clear the outer corrugations 22*e* of insert head portion 22*b*, and thus to allow auxiliary handle 20 to be able to pivot freely around pin 24. Thereafter, the user can pivot and position the auxiliary handle 20 in the desired position, and can tighten adjustment pin 24 in order to lock auxiliary handle 20 in this desired position. The number of different possible positions that auxiliary handle 20 can take is of course determined by the amount of corrugations 20*e* or 22*e* present on insert head portion 22*b* or on spacer portion 20*a* respectively; the angular play between two successive positions of auxiliary handle 20 is determined by the angular spacing between two juxtaposed ones of the regularly-spaced corrugations 20*e* or 22*e*. For example, if a 10° angle is defined between juxtaposed corrugations 20*e* or 22*e*, the auxiliary handle 20 can be locked into position at 10° intervals.

In alternate embodiments, any suitable alternate mounting means could be provided for mounting auxiliary handle 20 on nailer 10. Notably, unlike the above-described embodiment. where the number of positions the auxiliary handle can be locked in is limited by the number of corrugations 20*e* or 22*e*, the mounting means could be of the type allowing the auxiliary handle 20 to be locked in an unlimited number of positions.

It is understood that the auxiliary handle of the present invention could either be an integral feature of a new hardwood flooring nailer, or could be retrofitted on any conventional, existing hardwood flooring nailer. If the auxiliary handle is intended to be retrofitted on an existing nailer, it could be for example sold in a package along with the pivotal mounting means, the pivotal mounting means being of course adapted specifically to the design of the nailer it is intended to be installed on, to ensure proper pivotal mounting of the auxiliary handle thereon.

The combination of stationary main handle 13 and of selectively pivotable auxiliary handle 20 movably mounted to stationary handle 13 therefore provides the nailer with a versatile U-shaped double handle, which can be adjusted at the workman's will depending on the application. The vertical offset between auxiliary handle 20 and the bottom of the nailer, as well as the horizontal offset of auxiliary handle 20 relative to main handle 13, can be calibrated at the workman's will by changing the auxiliary handle's pivotal position, therefore permitting better handling of the nailer and allowing the workman to work in more ergonomic positions.

When a workman is working on a hardwood flooring, i.e. when assembling hardwood planks one after the other to form a flooring, the workman must suitably position each plank at the desired anchoring location such that is interlocked, for example, with the surrounding, already installed tongue-and-groove planks. After the plank has been properly positioned, the workman lays the nailer atop a hardwood plank at a first nailing point, and triggers the nailer to discharge a fastener into the plank. Then, he has to laterally slide the nailer about the plank towards a second nailing point spaced from the first nailing point, and then triggers the nailer by striking the anvil trigger member 17 with his mallet. The workman then repeats this "slide-and-nail" procedure as many times as necessary to properly secure the tongue-and-groove plank to the subfloor.

Similarly, the workman thereafter positions the remaining planks one after the other, lays down his nailer thereon and repeats the "slide-and-nail" routine on each plank to secure them to the subfloor and to progressively form the whole hardwood flooring. The workman therefore has to move around a great deal with the nailer in one hand and a mallet in the other, to complete the assembly of a hardwood flooring.

Figure 5:
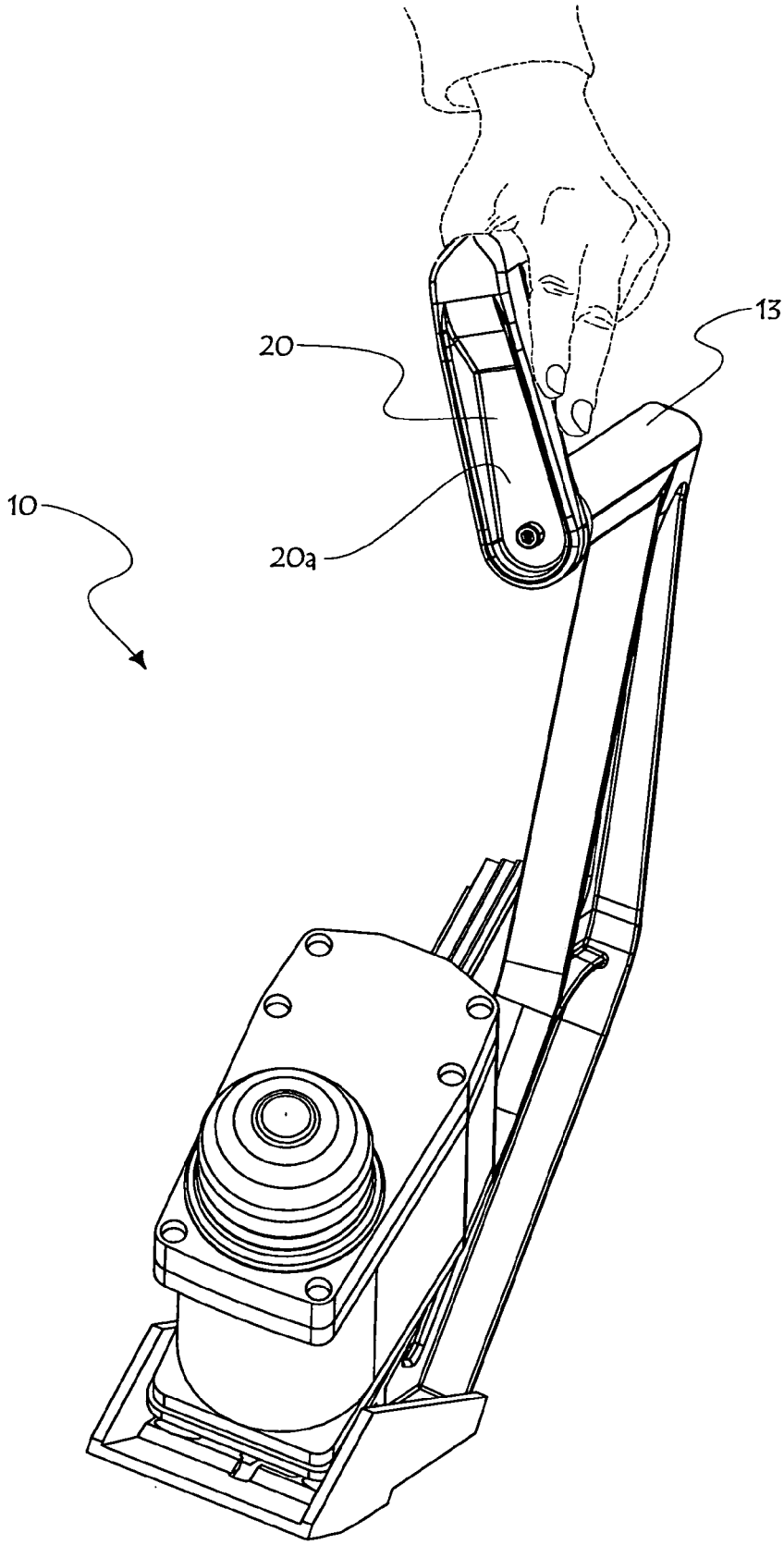
FIGS. 5–7 are perspective views of the nailer of FIG. 1 with its double handle adjusted in various grasping configurations, a workman's hand being shown in dotted lines to illustrate how the workman can manipulate the nailer.

With a traditional nailer, this procedure can be very tiresome for the back and arms, as the workman has to bend downwardly into an awkward stance to lay the nailer down atop each hardwood planks, and to slide the nailer from a nailing point to another. However, with the adjustable double handle of the present invention, the workman can pivot and adjust the auxiliary handle 20 upwardly in a raised position as shown in FIG. 5 to manipulate the nailer without having to bend downwardly in an awkward stance. Indeed, the workman can grasp the nailer handgrip portion 20*b* of the raised auxiliary handle 20 without bending down, and can lean one or two fingers on the spacer portion 20*a* (as illustrated in FIG. 5) to better manipulate the nailer and to displace it from a nailing point to the other. In this raised position of the auxiliary handle, the workman can work while keeping his back straight, and to work in generally more ergonomic positions.

In nailers only provided with a bar-like stationary handle such as main handle 13 and lacking the adjustable double handle of the present invention, the workman must clasp the handle very tightly to constrain it from swinging freely from side to side when transporting the nailer spacedly over ground, which can be very tiring for the fingers and the forearm muscles. In the grasping configuration of the double handle shown in FIG. 5, the workman can keep his fingers on spacer portion 20*a* of auxiliary handle 20 to constrain the nailer from swinging freely, especially when it is being carried over ground. By positioning his fingers in this manner, the workman also gains better control of the heavy nailer.

Figure 6:
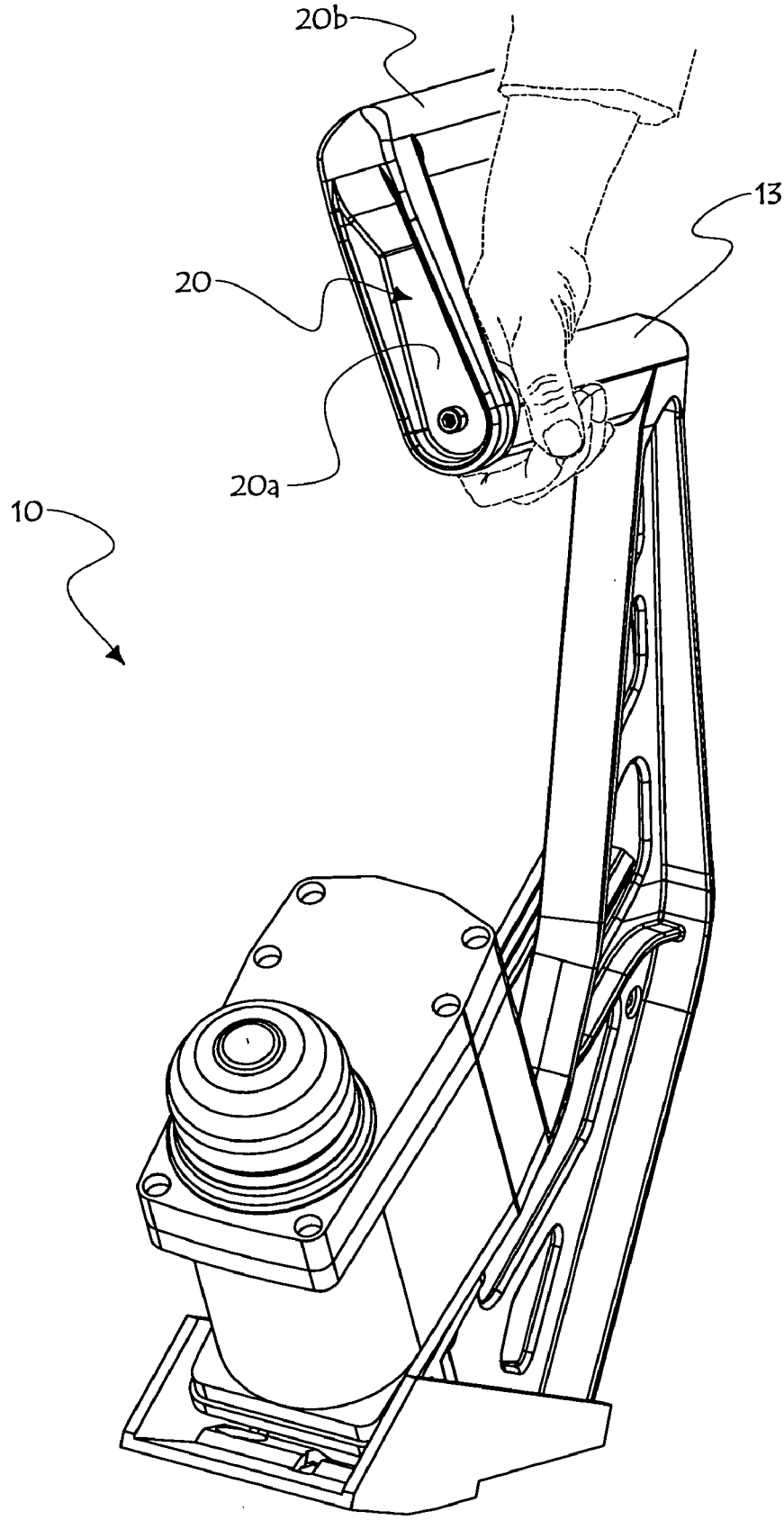

In addition, as shown in FIG. 6, auxiliary handle 20 can be adjusted in a raised position, and in a slightly inclined fashion such that the handgrip portion 20*b* is not directly vertically aligned above main handle 13 but rather slightly horizontally offset relative thereto. In this raised inclined position of auxiliary handle 20, the workman can grasp main handle 13 with his hand and rest his wrist against the auxiliary handle 20. This position allows the workman to use the auxiliary handle 20 as a fulcrum, against which he can lean his wrist, to allow him to better manoeuvre the nailer. For example, by grabbing the nailer as illustrated in FIG. 6, the workman can efficiently and more precisely control the nailer when slidably laterally displacing it along the length of a hardwood plank (during the "slide-and-nail" procedure). Also, by placing the auxiliary handle in this raised and inclined position, the workman can rest his wrist against the auxiliary handle when carrying the nailer around spacedly above the floor, to prevent the nailer from swinging freely from side to side. It thus allows the workman to get a better hold of the nailer when transporting it. It also becomes easier for the workman to lift and manoeuvre the weighty nailer against the downward pull of gravity.

Figure 7:
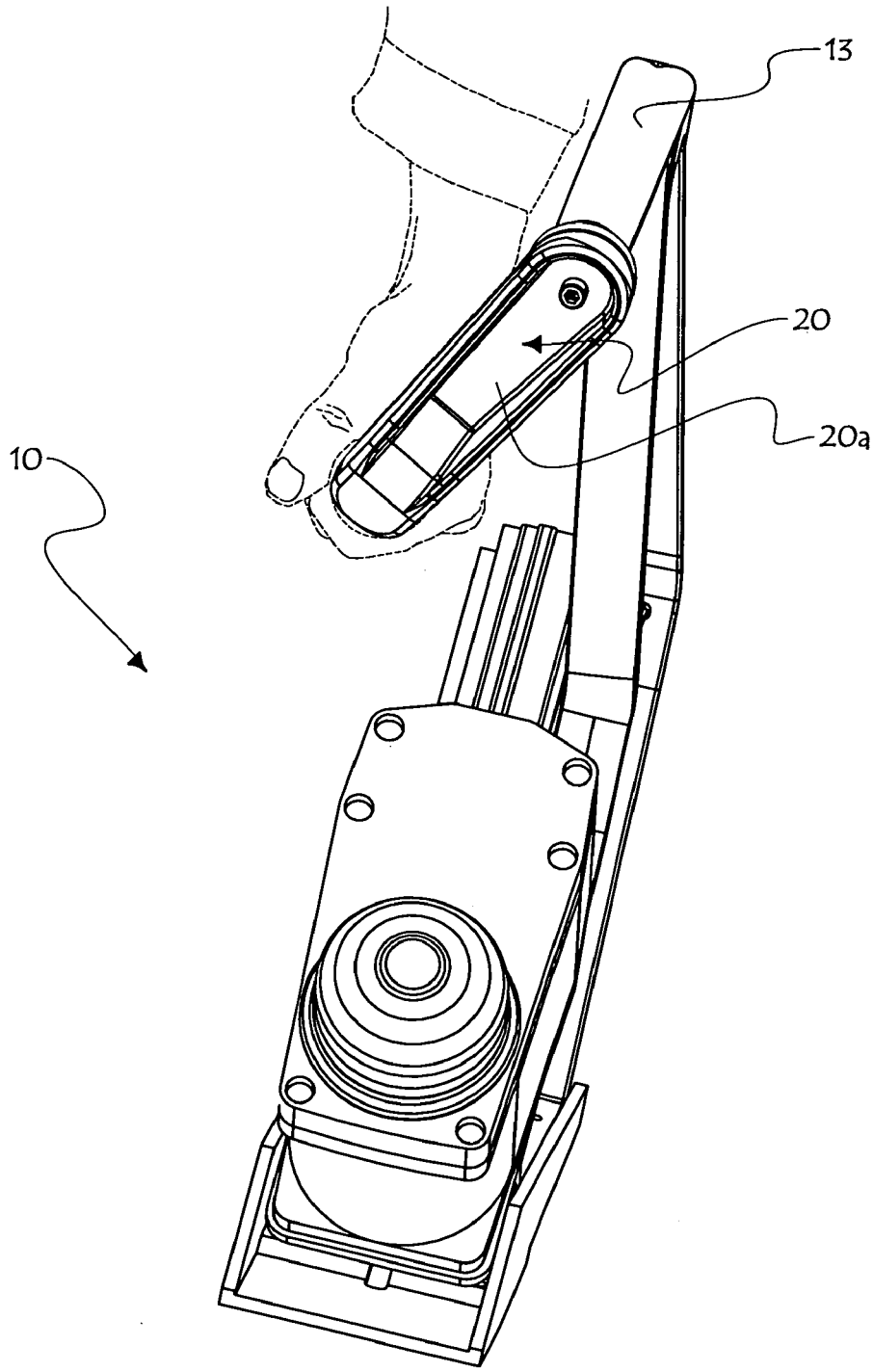

As shown in FIG. 7, auxiliary handle 20 can also be pivoted downwardly, such that auxiliary handgrip portion 20*b* is not directly vertically aligned underneath main handle 13, but rather slightly horizontally offset relative thereto. In this position, the workman can wrap his hand around the handgrip portion 20*b* of auxiliary handle 20, and rest his wrist against main handle 13 to get a firm hold of the nailer. This position is especially advantageous in that it allows the workman handling the nailer to get very close to the workpiece, and thus to gain better control of the tool and to manipulate it more precisely.

While the foregoing description lists different positions of auxiliary handle 20 and their respective advantages, it is understood that auxiliary handle 20 can be positioned in a very large number of other positions to suit the application and the workman's preferences, and which are not listed here for the sake of brevity.

It is also noted that even though the figures show the adjustable double handle of the present invention installed on a pneumatic nailer such as that described in detail in U.S. Pat. No. 4,907,730 issued on Mar. 13, 1990 for example, the adjustable handle could be fitted on other fastener driving tools for hardwood flooring. For example, the adjustable double handle could be used on a manual hardwood flooring nailer, which is not operated with compressed air, but uses rather only the force transmitted by the mallet blow to the nailer's trigger to plunge a fastener into a subjacent workpiece.

Figure 8:
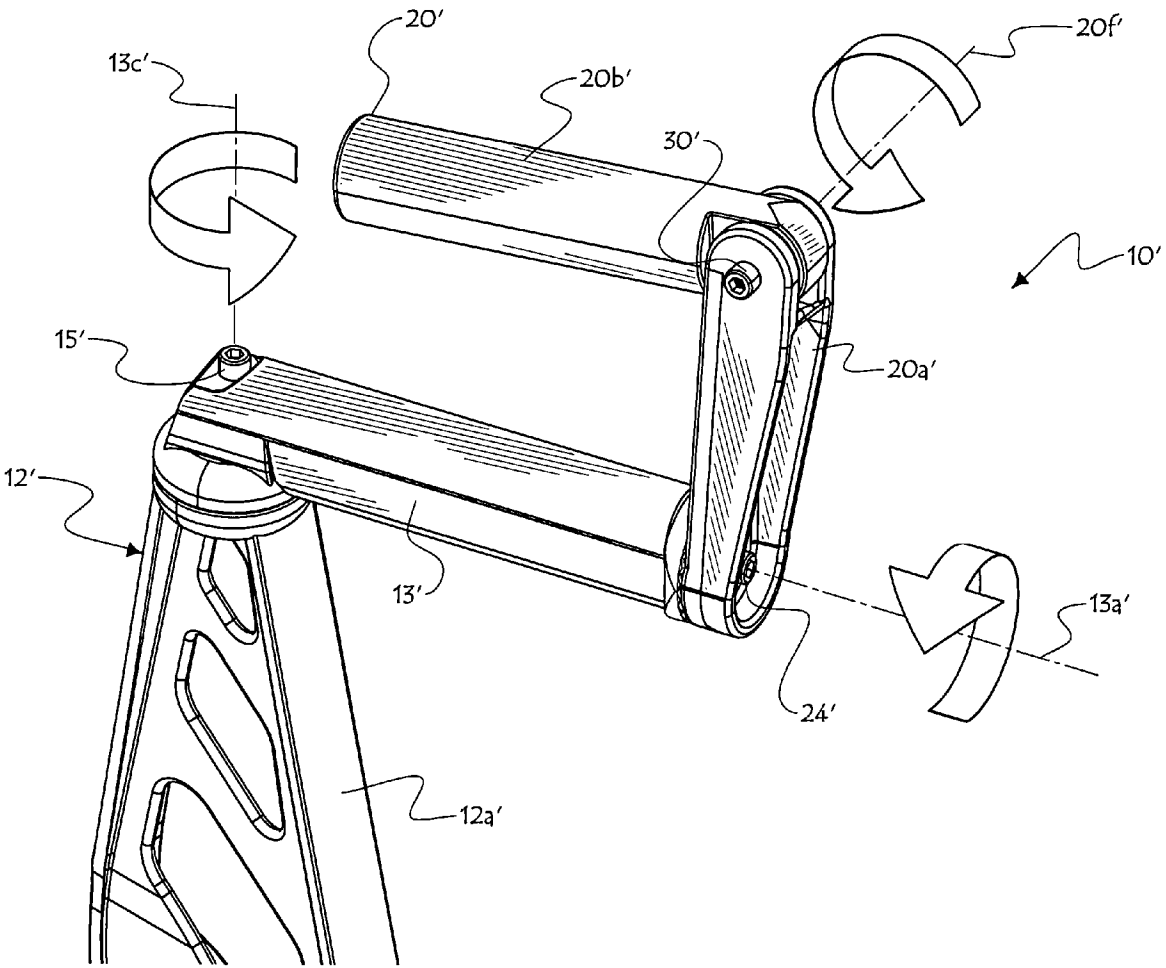
FIGS. 8–9 are perspective views of alternate embodiments of the adjustable double handle of the present invention, and suggesting with wide arrows the pivotal play of the various pivotal joints of the handle.
Figure 9:
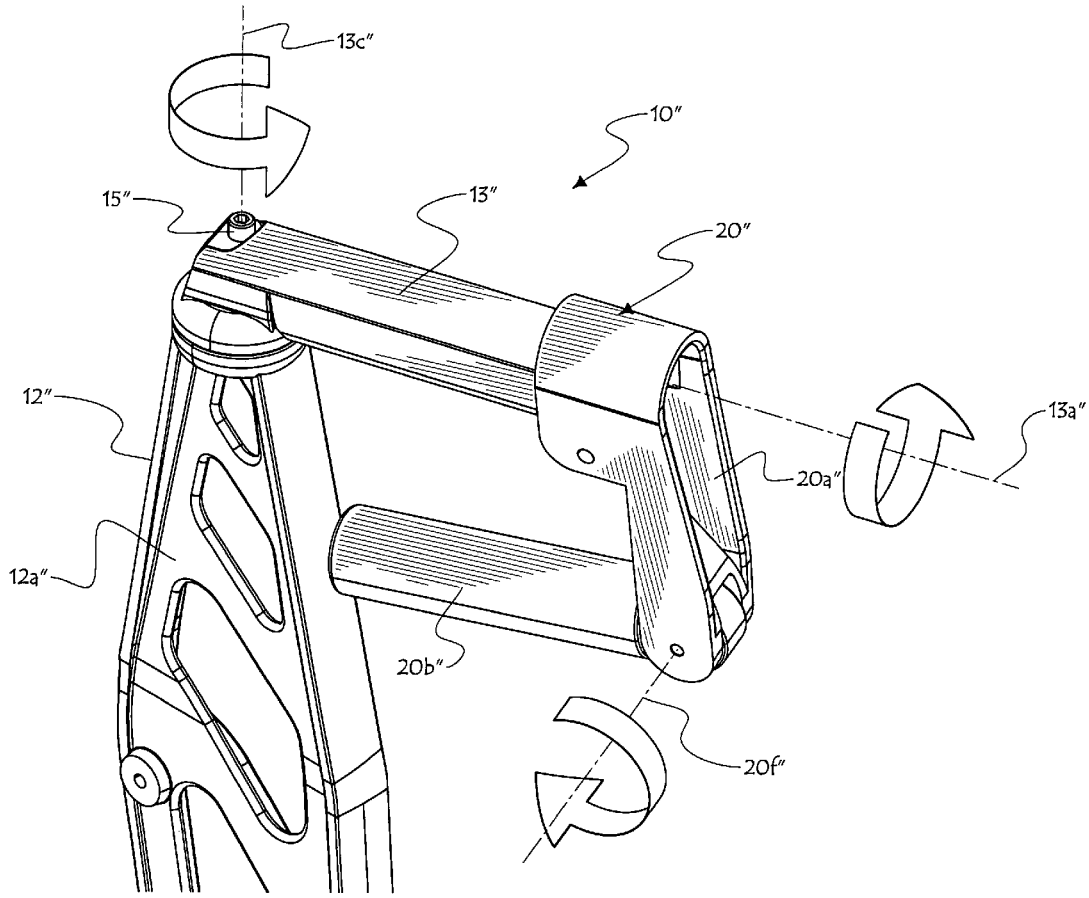

Alternate embodiments of the present invention could be envisioned, as illustrated in FIGS. 8 and 9. In the two alternate nailers of FIGS. 8 and 9, structures similar to that of the embodiment of FIGS. 1–7 are labelled with the same referral numbers but are suffixed with a prime for FIG. 8, and a double-prime for FIG. 9.

FIG. 8 partially shows a nailer 10' similar to nailer 10 of the first embodiment of FIGS. 1–7, but which includes a main handle 13' that is selectively pivotable relative to the nailer main frame central portion 12*a*' about a substantially vertical axis 13*c*' when nailer 10' stands flat on a horizontal surface. The pivotal position of main handle 13' relative to main frame central portion 12*a*' can therefore be adjusted by loosening adjustment pin 15', pivoting main handle 13' about axis 13*c*' in the desired position, and then by tightening pin 15' to lock it into position. Moreover, in addition to being pivotable about axis 13*a*' relative to main handle 13', the handgrip portion 20*b*' and spacer portion 20*a*' of auxiliary handle 20 are articulated. Indeed, the inner end of handgrip portion 20*b*' is pivotally connected to one end spacer portion 20*a*', and handgrip portion 20*b*' can be selectively pivoted about an axis 20*f*' relative to spacer portion 20*a*', by loosening a second adjustment pin 30'.

FIG. 9 shows an embodiment similar to that of FIG. 8, but where the mounting means of auxiliary handle 20" are different than that of the previous embodiments of FIGS. 1–8. These mounting means allow the auxiliary handle 20" to be pivotally mounted about the outer surface of the main handle 13" of the nailer, rather than being pivotally mounted using an insert forced into the inner cavity of a tubular main handle as in the previous embodiments. This sort of mounting means would allow the mounting of the auxiliary handle of the present invention on a nailer having a solid, non-hollow main handle.

The embodiments of the present invention, in which an exclusive property or privilege is claimed, are defined as follows:

1. A single arm operated fastener driving tool for hardwood flooring, said fastener driving tool destined to be loaded with at least one fastener, said fastener driving tool comprising:

a main rigid frame, for use with a fastener discharge mechanism attached to said main rigid frame and which can be activated for allowing said fastener driving tool to discharge a fastener; and a handle assembly for enabling single hand operation of said driving tool over the flooring, said handle assembly defining;

a) a hand grasping portion, integral to said main rigid frame and for grasping by one hand of an operator's arm; and b) fulcrum means, cooperating with said hand grasping portion in enabling an operator to manipulate and control said driving tool with the same operator's arm as the one by which said hand grasping portion is grasped;

wherein said hand grasping portion includes an inner end fixedly connected to said main rigid frame and an outer end, and wherein said fulcrum means consists of an auxiliary member, connected at one end by mounting means to said hand grasping portion outer end, said auxiliary member defining an inner leg, transversely projecting from and connected by mounting means to said hand grasping portion outer end, and a free outer end leg, transversely projecting from said inner leg thereof, said auxiliary member outer end leg and said hand grasping portion being in spaced register relative to one another.

2. A fastener driving tool according to claim 1, wherein said mounting means include means for controlled relative movement of said hand grasping portion relative to said auxiliary member inner leg.

3. A fastener driving tool for hardwood flooring, said fastener driving tool destined to be loaded with at least one fastener, said fastener driving tool comprising:

a main rigid frame, for use with a fastener discharge mechanism attached to said main rigid frame and which can be activated for allowing said fastener driving tool to discharge a fastener;

an adjustable double handle comprising:

a first handle defining an inner end connected to said main rigid frame and an outer end opposite to said inner end;

a second handle; and mounting means mounting said second handle to said first handle outer end;

wherein said first and said second handle can be selectively moved relative to one another in order to adjust said double handle in one of several different grasping configurations;

wherein said second handle is pivotally mounted to said first handle, said second handle being pivotable about a first pivot axis, and wherein a handgrip portion of said second handle is pivotally connected to a spacer portion, and is pivotable relative thereto about a second pivot axis transverse to said first pivot axis.

4. A fastener driving tool for hardwood flooring, said fastener drying tool destined to be loaded with at least one fastener, said fastener driving tool comprising:

a main frame, for use with a fastener discharge mechanism attached to said main frame and which can be activated for allowing said fastener driving tool to discharge a fastener;

an adjustable double handle carried by said main frame and comprising a first handle and a second handle, and mounting means mounting said first handle to said second handle;

wherein said first and said second handle can be selectively moved relative to one another in order to adjust said double handle in one of several different grasping configurations;

wherein said first handle is attached to said fastener driving tool main frame, and said second handle is movably attached to said first handle transversely thereto, and wherein said second handle can be selectively moved relative to first handle in order adjust double in one of said several grasping configurations;

wherein said mounting means include releasable locking means, said locking means allowing said movable second handle to be selectively locked in position, thus allowing said double handle to be selectively locked in one of said several grasping configurations;

wherein said first handle is fixedly connected to said fastener driving tool main frame transversely thereto;

wherein said second handle is pivotally attached to said first handle, said second handle being pivotable about a first pivot axis;

wherein said first handle is elongated and extends along a first handle axis, and wherein said second handle is L-shaped and defines a spacer portion pivotally attached by first end thereof to said first handle, and carrying at a second end a handgrip portion of said second handle, said handgrip portion being elongated and extending along a second handle axis; and wherein said first pivot axis coincides with said first handle axis, said second handle being thus selectively pivotable relative to said first handle axis.

5. A fastener driving tool according to claim 4, wherein said first handle axis and said second handle axis remain substantially parallel to each other in all of said grasping configurations of said double handle.

6. A fastener driving tool for hardwood flooring, said fastener driving tool destined to be loaded with at least one fastener, said fastener driving tool comprising:

a main rigid frame, for use with a fastener discharge mechanism attached to said main frame and which can he activated for allowing said fastener driving tool to discharge a fastener;

an adjustable double handle carried by said main frame and comprising a first handle and a second handle, and mounting means mounting said first handle to said second handle;

wherein said first and said second handle can be selectively moved relative to one another in order to adjust said double handle in one of several different grasping configurations;

wherein said second handle is pivotally mounted with respect to said first handle axis, said second handle being pivotable about a first pivot axis, and wherein a handgrip portion of said second handle is pivotally connected to a spacer portion, and is pivotable relative thereto about a second pivot axis transverse to said first pivot axis; and wherein said first handle is pivotally attached to said fastener driving tool main frame, said first handle being pivotable about a third pivot axis transverse to said first and said second pivot axes.

* * * * *